US008376158B2

(12) United States Patent
Kaneko et al.

(10) Patent No.: US 8,376,158 B2
(45) Date of Patent: Feb. 19, 2013

(54) HEAVY CONSTRUCTION INSTALLATION METHOD

(75) Inventors: Yuji Kaneko, Hitachi (JP); Ryohel Miyahara, Hitachi (JP); Sumito Maezawa, Tokyo (JP); Kensuke Morita, Hitachi (JP); Takashi Okano, Hitachi (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 579 days.

(21) Appl. No.: 12/706,995

(22) Filed: Feb. 17, 2010

(65) Prior Publication Data

US 2010/0206830 A1 Aug. 19, 2010

(30) Foreign Application Priority Data

Feb. 17, 2009 (JP) ..... 2009-033940

(51) Int. Cl.
*B66C 13/06* (2006.01)

(52) U.S. Cl. ..... 212/270; 212/280; 212/281

(58) Field of Classification Search ..... 212/281, 212/280, 227, 270
See application file for complete search history.

(56) References Cited

U.S. PATENT DOCUMENTS

| | | | | |
|---|---|---|---|---|
| 1,614,575 | A * | 1/1927 | Siebs | 212/278 |
| 5,160,056 | A * | 11/1992 | Yoshimatsu et al. | 212/277 |
| 5,198,800 | A * | 3/1993 | Tozawa et al. | 340/573.1 |
| 5,799,805 | A * | 9/1998 | Mård et al. | 212/270 |
| 7,395,940 | B2 * | 7/2008 | Abel et al. | 212/270 |
| 2007/0023377 | A1 * | 2/2007 | Abel et al. | 212/270 |
| 2007/0221600 | A1 * | 9/2007 | Davis | 212/270 |

FOREIGN PATENT DOCUMENTS

| | | |
|---|---|---|
| JP | 58-86494 | 6/1983 |
| JP | 07-097867 | 4/1995 |
| JP | 10-104383 | 4/1998 |
| JP | 11-036590 | 2/1999 |

* cited by examiner

*Primary Examiner* — Emmanuel M Marcelo
(74) *Attorney, Agent, or Firm* — Antonelli, Terry, Stout & Kraus, LLP.

(57) ABSTRACT

There is provided a heavy construction installation method which does not need a secondarily transport in a construction field even if an installation position of a heavy construction is apart from a berthing position of a transport ship. A movable area where a ground plane is reinforced so that a heavy hoisting machine for installing a heavy construction in a building is movable is constructed so as to include a circle drawn around an installation position in the building with a maximum operating radius of the heavy hoisting machine relative to a weight of the heavy construction being as a radius, and a circle drawn around a loaded position of the heavy construction at a transport ship coming alongside a landing place with the maximum operating radius being as a radius.

2 Claims, 8 Drawing Sheets

SECOND COMPARATIVE EXAMPLE

FIRST COMPARATIVE E EXAMPLE

SECOND COMPARATIVE EXAMPLE

HEAVY CONSTRUCTION INSTALLATION METHOD

CROSS REFERENCE TO RELATED APPLICATIONS

This application claims the foreign priority benefit under 35 U.S.C. §119 of Japanese Patent Application No. 2009-033940 filed on Feb. 17, 2009, the disclosure of which is incorporated herein by reference.

BACKGROUND OF THE INVENTION

1. Field of the Invention

The present invention relates to a method of installing a heavy construction, and more particularly, a construction technique of landing a heavy construction transported by ship and of installing the heavy construction inside a building in construction of a seaside plant.

2. Description of the Related Art

Relating to large-scale seaside plants like nuclear power generation facilities, a large-size heavy construction (e.g., a nuclear reactor pressure vessel) which is conveyed inside a building (e.g., a nuclear reactor building, a nuclear-reactor-building attached ridge, a turbine building) built in a site is generally manufactured at a factory far apart from the site, and transported by ship to a construction field.

Adopted in recent large-scale plant construction is a construction technique of integrally manufacturing various equipment and pipes beforehand at a factory in a remote area, of transporting a heavy construction manufactured in this manner by ship to a construction field of a plant, and of installing such a heavy construction on the site of a building. This construction technique is so-called a modular construction.

Such a large-size heavy construction transported by ship is landed by a heavy hoisting machine like a crane, and is installed at a predetermined place in a site where a building is to be built (see, for example, JPS58-86494A and JPH10-104383A).

According to JPS58-86494A and JPH10-104383A, however, because the heavy hoisting machine is fixed or can only move linearly over rails, the range of an installation position of the heavy construction is limited.

Moreover, when the installation position in a building is distant from a place where a ship comes alongside the pier and the heavy construction is landed, it is necessary to once put the heavy construction on a specialized vehicle or the like, and to secondarily transport the heavy construction close to the heavy hoisting machine as will be explained with reference to first and second comparative examples to be discussed later. In this case, because the number of works increases due to once putting the heavy construction on a specialized vehicle, the construction cost increases, and the construction schedule is protracted.

SUMMARY OF THE INVENTION

The present invention has been made in view of the foregoing problem, and it is an object of the present invention to provide a heavy construction installation method which is appropriate when the installation position of the heavy construction is distant from a place where a transport ship comes alongside the pier.

In order to achieve the above object, the present invention provides a method of installing a heavy construction, wherein a movable area where a ground plane is reinforced so that a heavy hoisting machine for installing a heavy construction at a predetermined installation position is movable is constructed so as to include a circle drawn around the installation position with a maximum operating radius of the heavy hoisting machine relative to a weight of the heavy construction being as a radius, and a circle drawn around a loaded position of the heavy construction at a transport ship coming alongside a landing place with the maximum operating radius being as a radius.

In general, when a heavy hoisting machine slings up a heavy construction, large couple is applied to the main body of the heavy hoisting machine, so that it is desirable that a ground plane should have a high rigidity. According to the present invention, a movable area of the heavy hoisting machine that the ground plane is reinforced in such a way is defined as explained above, so that procedures from landing of the heavy construction to installation thereof can be carried out by moving one hoisting device.

Other features and advantages of the present invention will become more apparent from the following detailed descriptions of the invention when taken in conjunction with the accompanying drawings.

BRIEF DESCRIPTION OF THE DRAWINGS

FIGS. 1A and 1B are side views of a heavy hoisting machine used in a heavy construction installation method of the present invention, wherein FIG. 1A shows how a heavy construction is hoisted, and FIG. 1B shows how the heavy construction is installed at a predetermined installation position;

DETAILED DESCRIPTION OF THE PREFERRED EMBODIMENTS

First Embodiment

An explanation will be given of an embodiment of a heavy construction installation method of the present invention with reference to the accompanying drawings.

Figure 1A:
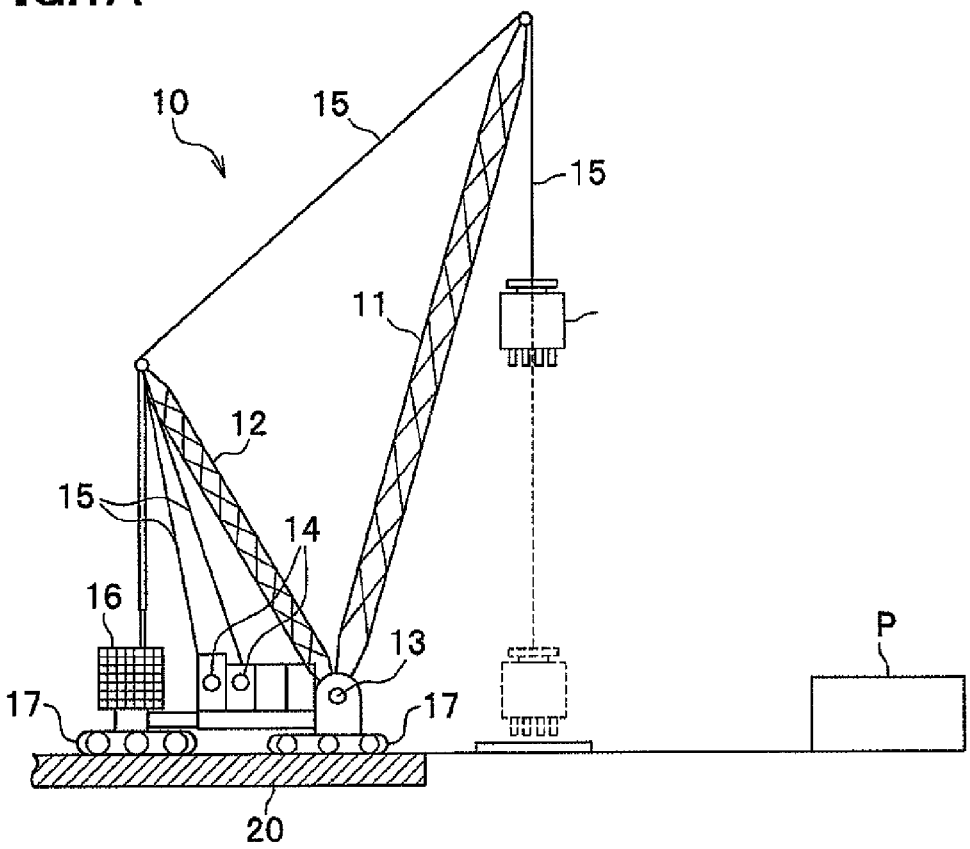
Figure 1B:
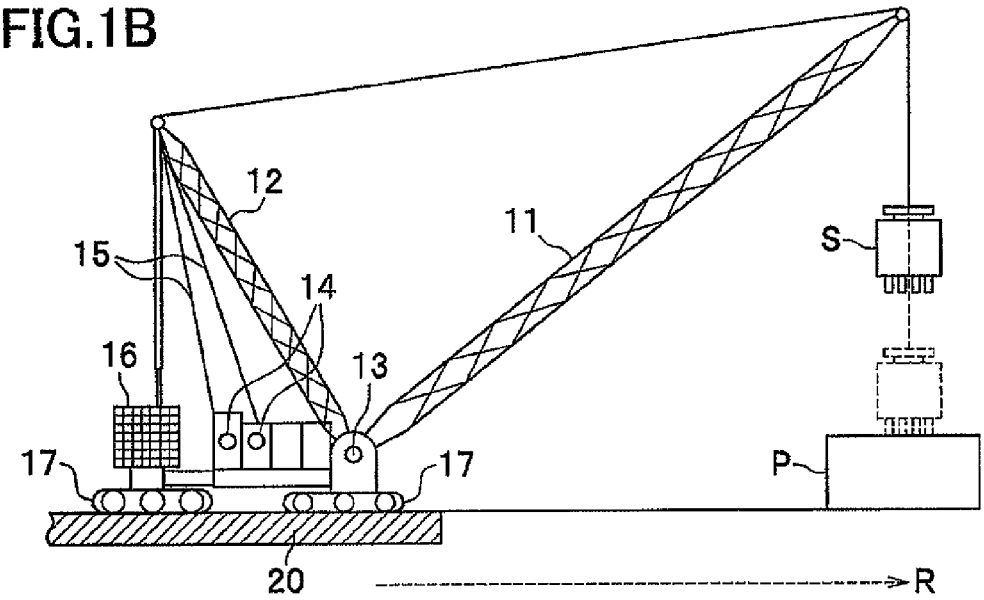

A heavy hoisting machine 10 shown in FIGS. 1A and 1B is an appropriate crane for the heavy construction installation method of the present invention. The heavy hoisting machine 10 comprises a boom 11 and a front stay 12 both of which can rotate around a supporting point 13, a hoist 14 which winds up a wire 15 to sling up and sling down a heavy construction S attached to the leading end of the wire 15 and adjusts the angle of the boom 11 to set an operating radius, a counter weight 16, and caterpillars 17.

The heavy hoisting machine 10 structured in this fashion slings up the heavy construction S as shown in FIG. 1A, and installs the heavy construction S at a predetermined installation position P apart by an operating radius R as shown in FIG. 1B.

As is clear from FIG. 1B, the weight of the heavy construction S and couple proportional to the operating radius R are applied to the supporting point 13. The weight 16 is provided in order to cancel the couple, and the weight of the weight 16 is adjusted in accordance with the maximum product of the heavy construction S to be installed and the operating radius R.

A rigid body plate 20 forms a surface layer of a movable area 20A (see FIGS. 2A and 2B) where a ground plane is reinforced so that the heavy hoisting machine 10 can move. That is, the heavy hoisting machine 10 for installing the heavy construction S at the installation position P is heavy in weight because it has the weight 16 heavy in weight in order to cancel large couple. Accordingly, it is necessary that the rigid body plate 20 which is the ground contact area of the heavy hoisting machine 10 must have a high mechanical strength, and the movable area 20A (see FIGS. 2A and 2B) of the heavy hoisting machine 10 is thus limited to a range where the rigid body plate 20 is provided.

It is desirable that such a rigid body plate 20 should have a minimum area from the standpoint of suppressing any increment of the construction cost of a plant because it is necessary to dig the ground to a predetermined depth and to cause the rigid body plate 20 to have a predetermined thickness.

Figure 2A:
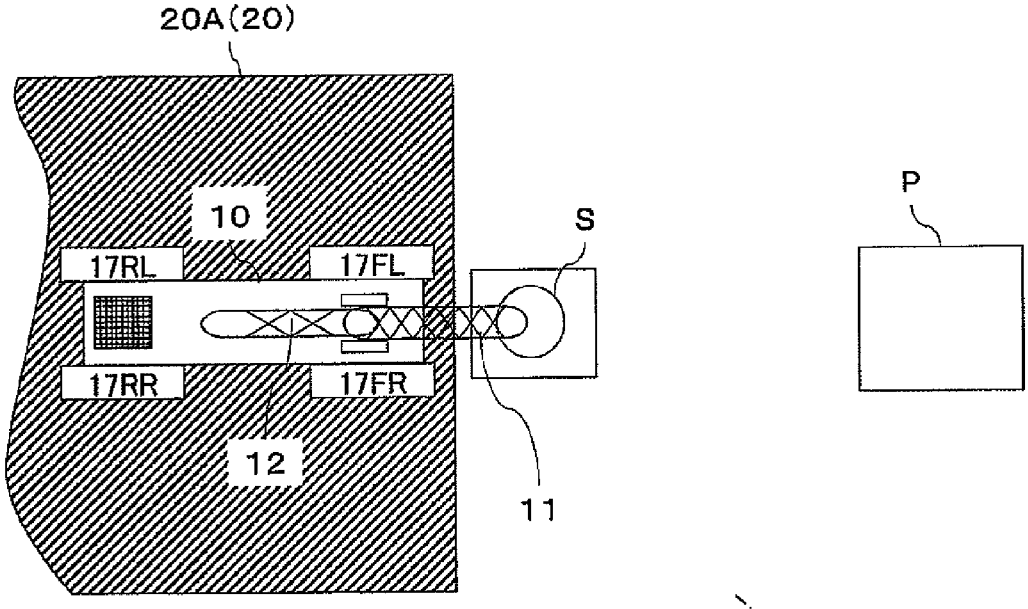
FIGS. 2A and 2B are top views of FIGS. 1A and 1B, respectively.
Figure 2B:
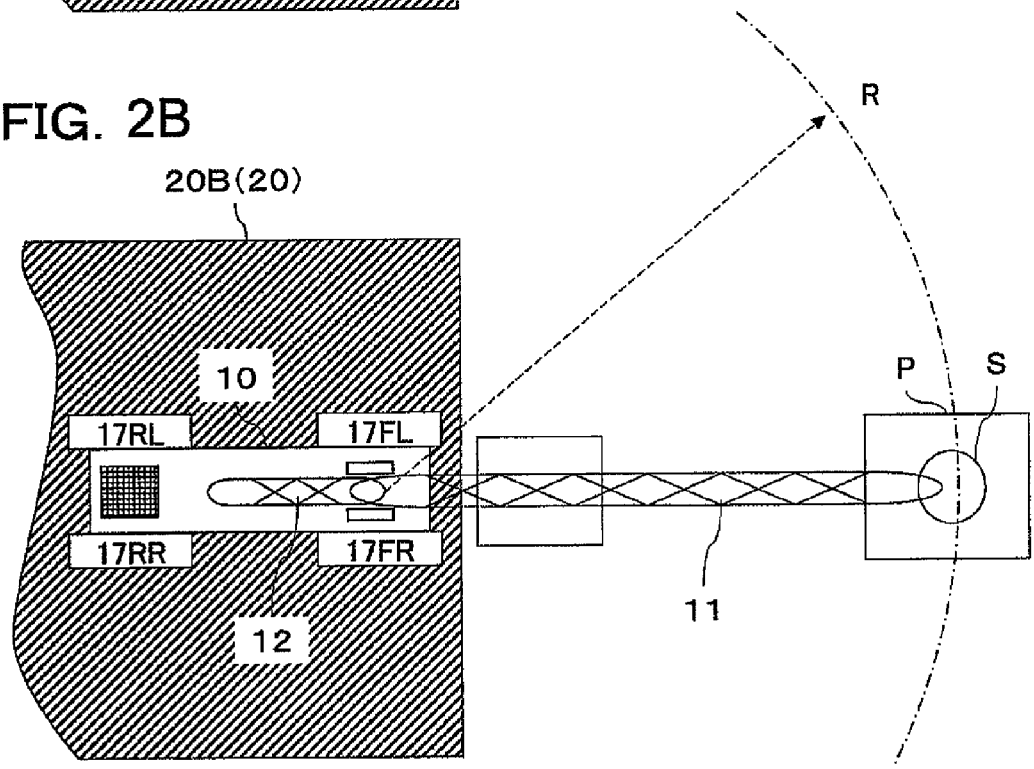

As is shown in top plan views of FIGS. 2A and 2B showing the heavy hoisting machine 10, as the four caterpillars 17 (17FL, 17FR, 17RL, and 17RR) provided front and back and right and left of the heavy hoisting machine 10 rotate, the heavy hoisting machine 10 can change its direction and its position. Accordingly, the heavy hoisting machine 10 can freely move within the movable area 20A, and a range where the heavy construction S can be installed is set based on the operating radius R of the heavy hoisting machine 10 and the size of the movable area 20A.

Figure 3:
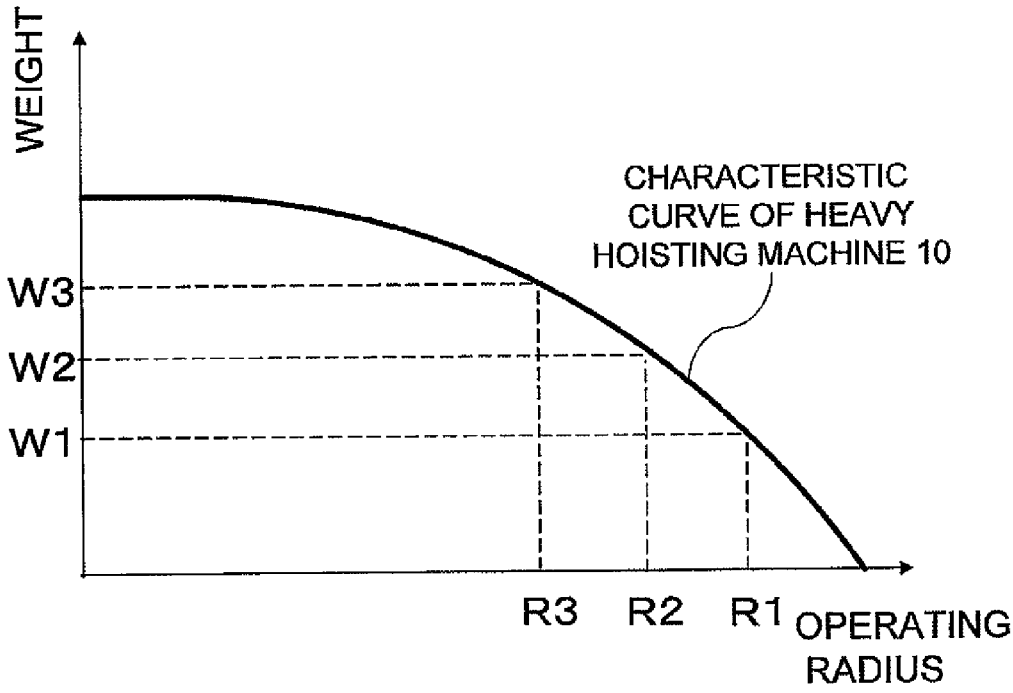
FIG. 3 is a graph of a characteristic curve indicating a relationship between an operating radius of the heavy hoisting machine shown in FIGS. 1A and 1B and a weight of a heavy construction which can be installed.
Figure 4A:
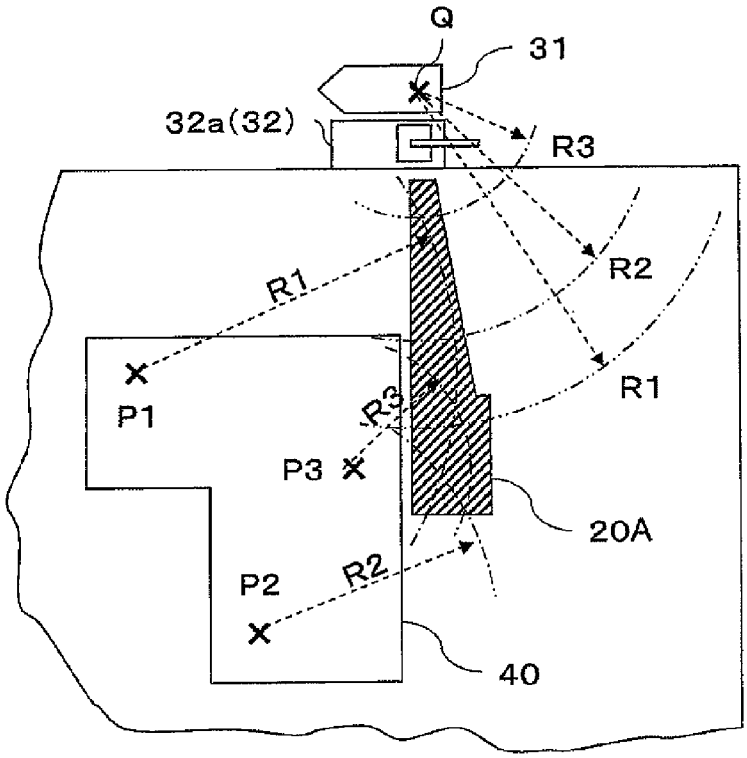
FIG. 4A is a bird-eye view showing a construction field where a heavy construction installation method according to a first embodiment of the present invention is applied.

FIG. 3 is a graph of a characteristic curve indicating a relationship between an operating radius of the heavy hoisting machine 10 and a weight of a heavy construction which can be installed. FIG. 4A shows a construction field where the heavy construction installation method of the first embodiment is applied.

It is supposed that plural installation positions Pin a site of a building 40 are P1, P2, and P3, and weights W of heavy constructions S to be installed are W1, W2, and W3, respectively (W1<W2<W3). Then, distances to P1, P2, and P3 from the movable area 20A must be shorter than maximum operating radii R1, R2, and R3, respectively, which are clear from FIG. 3.

Moreover, in order to allow the heavy hoisting machine 10 to land the heavy construction S loaded on a transport ship 31 which is coming alongside a landing place 32, a distance from a load place Q to the movable area 20A must be shorter than the maximum operation radius R3 which is the smallest radius.

Therefore, in order to land the heavy construction S from the transport ship 31 by moving one heavy hoisting machine 10 and to install the heavy construction S at a predetermined installation position P in the building 40, the following condition must be satisfied.

That is, providing that (1) circles each having a radius of the maximum operating radius R (R1, R2, and R3) of the heavy hoisting machine 10 relative to the weight W (W1, W2, and W3) of the heavy construction S are drawn with the installation position P (P1, P2, and P3) of the heavy construction S at a predetermined position in the site of the building 40 being as a center; and (2) a circle having a radius which is the smallest radius (R3) among the maximum operating radii R (R1, R2, and R3) is drawn around the load place Q, the movable area 20A must be set in such a manner as to include all the circles drawn around the installation positions P1, P2, and P3 and the load place Q.

Note that the exemplified contour of the movable area 20A has a rectangular part where the heavy hoisting machine 10 is located when installing the heavy construction S at the installation position P and has a narrowing part with a width becoming narrow toward the place where the heavy hoisting machine 10 is located when landing the heavy construction S from the transport ship 31, but the contour of the movable range is not limited to such a contour.

Second Embodiment

Figure 4B:
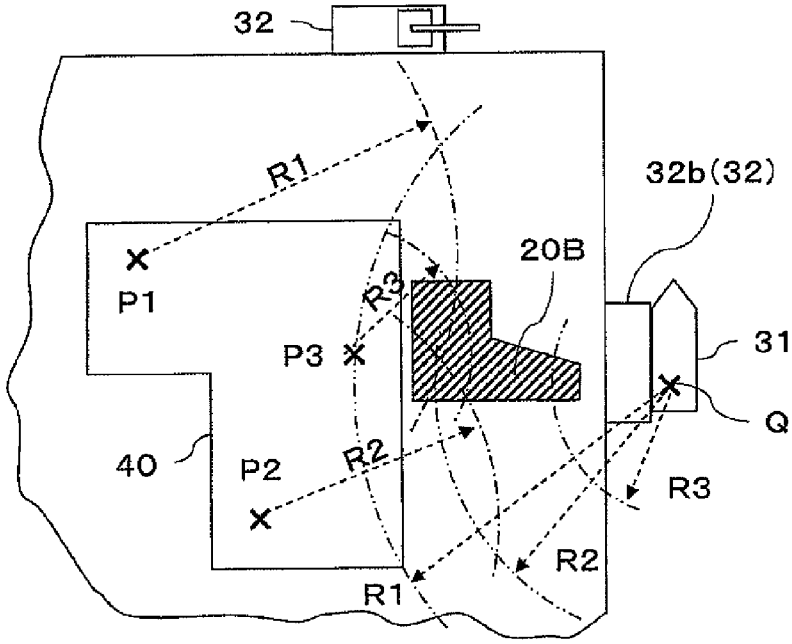
FIG. 4B is a bird-eye view showing a construction field where a heavy construction installation method according to a second embodiment of the present invention is applied.

Next, an explanation will be given of a heavy construction installation method according to a second embodiment with reference to FIG. 4B showing a construction field. The second embodiment differs from the first embodiment (see FIG. 4A) in that the permanent landing place 32*a* is not utilized but a temporal landing place 32*b* is utilized. Note that the same structural part as that of the first embodiment will be denoted by the same reference numeral, and the duplicated explanation thereof will be omitted.

The temporal landing place 32*b* has a function of just allowing the transport ship 31 to come alongside the pier and to be tied up, and more specifically, is like a conventionally-well-known mega-float. Similarly to the concept explained above, a movable area 20B is set in such a manner as to include a circle drawn around the load place Q (the center of the circle) at the temporal landing place 32*b* with a radius R3.

What is important in the second embodiment is that the set movable area 20B must have a smaller area than that of the movable area 20A planned when the permanent landing place 32*a* is supposed to be utilized.

Moreover, when it is supposed that the establishment cost of the temporal landing place 32*b* is C1, the establishment cost of the movable area 20B is C2, and the establishment cost of the movable area 20A is C3, then, it is necessary to satisfy a condition: C1+C2<C3. Thus way, an effect of suppressing any increment of a construction cost of a plant can be achieved.

Explanation for Procedures of the Foregoing Two Embodiments

Figure 5:
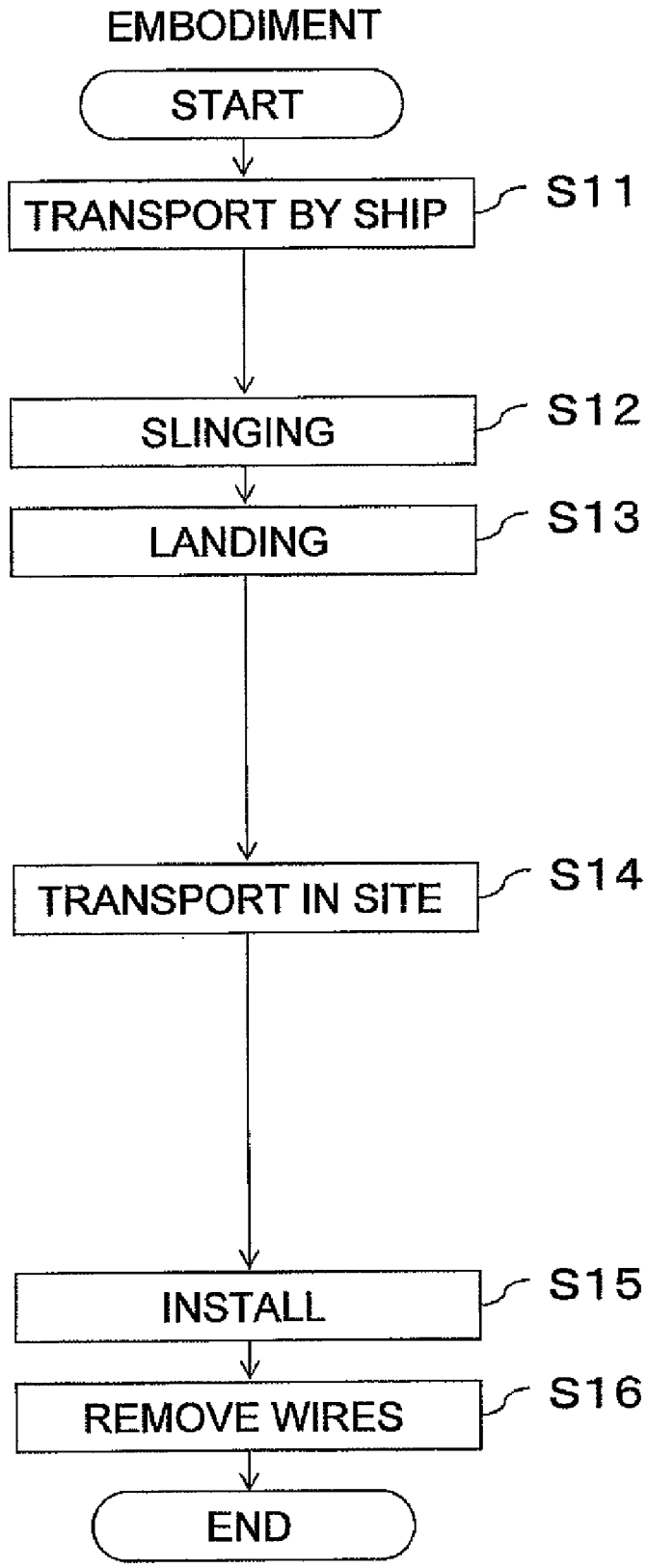
FIG. 5 is a flowchart of a heavy construction installation method of the present invention.

Next, an explanation will be given of the procedures of the heavy construction installation method according to the embodiments with reference to the flowchart of FIG. 5 (and FIGS. 4A and 4B accordingly).

First, the heavy construction S manufactured at a factory at a remote area is loaded on the transport ship 31 and transported by ship to a landing place 32 of a plant construction field (step S11). The heavy hoisting machine 10 is moved closed to the landing place 32 before the transport ship 31 comes alongside the pier, and after the transport ship 31 comes alongside the pier, a crane operation of slinging the heavy construction S loaded on the transport ship 31 with the wire 15 (see FIG. 1) is carried out (step S12).

Next, the hoist 14 of the heavy hoisting machine 10 is driven to sling up the heavy construction S and to land it (step S13). Thereafter, the heavy hoisting machine 10 is moved and caused to change its direction, and the heavy construction S is transported within a field in such a way that the lifted heavy construction S is positioned above the installation position P in the site of the building 40 (step S14).

Next, the hoist 14 of the heavy hoisting machine 10 is driven to sling down the heavy construction S to install the heavy construction S at the installation position P (step S15). Thereafter, the wire 15 attached to the heavy construction S is removed (step S16).

According to the above-explained procedures of the embodiments, a secondarily transport relating to steps S22 to S28 of a first comparative example to be discussed later and the steps S42 to S47 of a second comparative example to be also discussed later can be eliminated, so that the number of works can be reduced, thereby reducing a construction cost and shortening a construction schedule.

Explanation for First Comparative Example

Figure 6A:
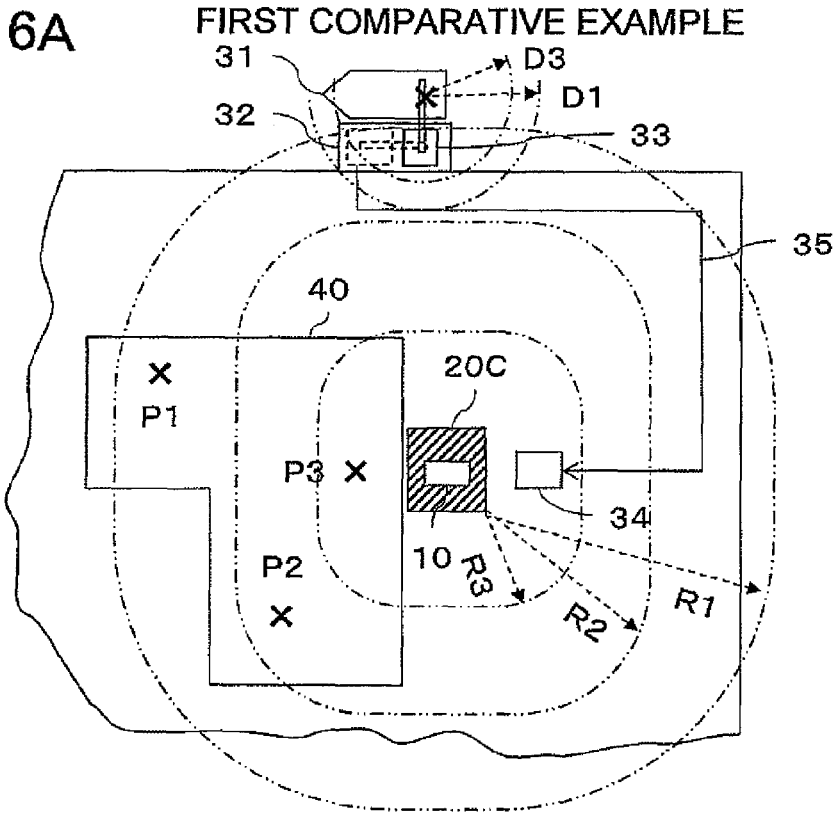
FIG. 6A is a bird-eye view showing a construction field according to a first comparative example.

Next, to verify the effect of the present invention, an explanation will be given of the first comparative example with reference to FIG. 6A showing a construction field.

In the first comparative example, a movable area 20C where the heavy hoisting machine 10 can move is set to a size merely sufficient to install the heavy construction S at the installation positions P (P1, P2, and P3) in the site of the building 40.

Figure 6B:
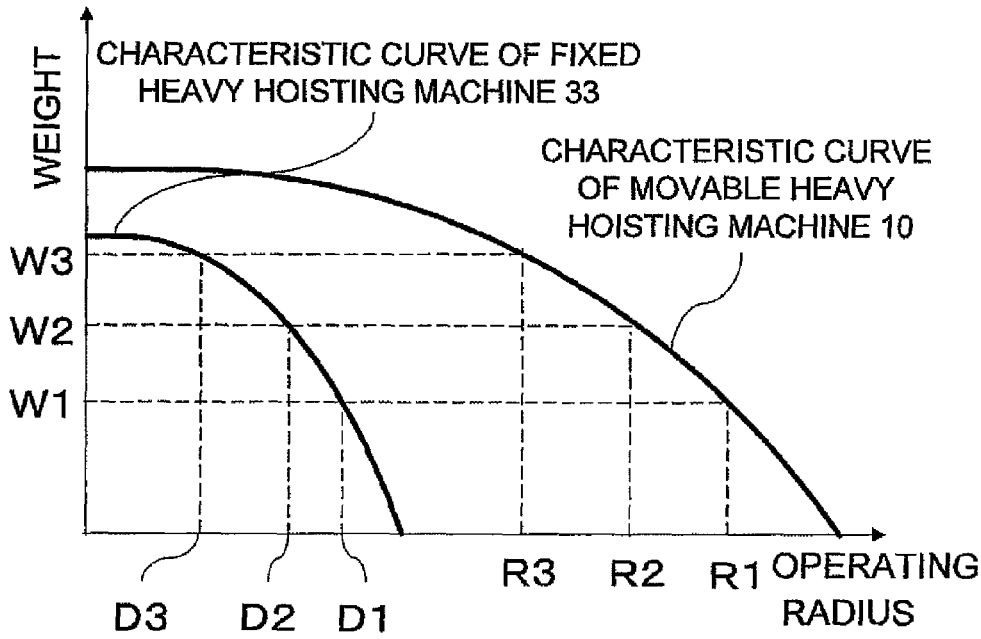
FIG. 6B is a graph in which the characteristic curve of a heavy hoisting machine provided at a permanent landing place is overwritten on the characteristic curve in FIG. 3.

Accordingly, the working envelopes where the movable heavy hoisting machine 10 can install the heavy constructions S with a weight W1, a weight W2, and a weight W3 are limited to rectangular ranges whose corners are curved in curvature radii of R1, R2, and R3, respectively, as shown in FIG. 6B.

In this case, it is clear that the heavy hoisting machine 10 is unable to land the heavy construction S loaded on the transport ship 31. Accordingly, landing of the heavy construction S is carried out using a fixed heavy hoisting machine 33 arranged at the permanent landing place 32*a*.

Since the fixed heavy hoisting machine 33 has a small operating radius R as indicated by a characteristic curve in FIG. 6B, the fixed heavy hoisting machine 33 can merely land the heavy construction S loaded on the transport ship 31 on the permanent landing place 32*a* to the utmost. Therefore, the first comparative example needs a large-size specialized vehicle 34 which transports the landed heavy construction S to the vicinity of the movable area 20C of the heavy hoisting machine 10, and an in-site road 35 constructed well beforehand where the specialized vehicle 34 can drive.

Figure 8A:
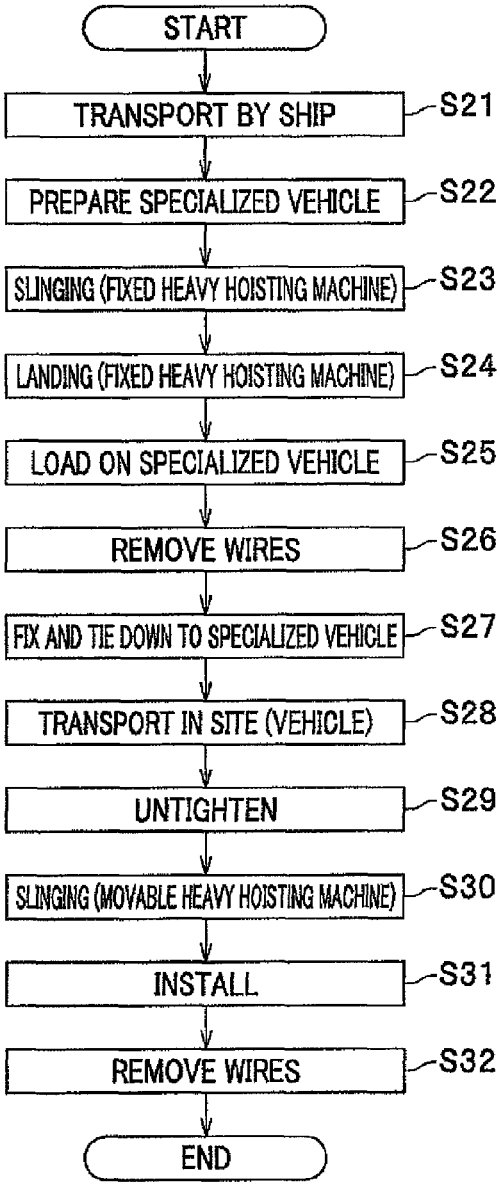
FIG. 8A is a flowchart of the first comparative example.

Next, an explanation will be given of the procedures of the first comparative example with reference to the flowchart of FIG. 8A.

First, the heavy construction S is transported by the transport ship 31 (step S21), and before the transport ship 31 comes alongside the pier, the specialized vehicle 34 is prepared at the landing place 32 (step S22). After the transport ship 31 comes alongside the pier, the heavy construction S loaded on the transport ship 31 is slung on the fixed heavy hoisting machine 33 (step S23), and lifted to land the heavy construction S (step S24). The fixed heavy hoisting machine 33 is turned to load the heavy construction S on the specialized vehicle 34 (step S34), and then a wire is removed (step S26).

Furthermore, the heavy construction S is fixed and tied down to the specialized vehicle 34 so as not to move (step S27), the specialized vehicle 34 is run on the in-site road 35 to transport the heavy construction S in the construction field (step S28). When the specialized vehicle 34 reaches the proximity of the movable area 20C of the movable heavy hoisting machine 10, the heavy construction S fastened and tied down is untightened (step S29). The heavy construction S is slung on the heavy hoisting machine 10 (step S30), and lifted. The heavy hoisting machine 10 is moved and caused to change its direction to position the hoisted heavy construction S right above the installation position P, the heavy construction S is slung down, thereby installing the heavy construction S at the installation position P (step S31). Thereafter, wires are released from the heavy construction S (step S32), and then successive operations complete.

As explained above, according to the first comparative example, the number of works is larger than the present invention by what corresponds to the steps S22 to S29 relating to secondarily transport in the field.

When it is supposed that a facility cost of the movable area 20A of the present invention is C1, a facility cost of the movable area 20C of the first comparative example is C4, a facility cost of the in-site road 35 is C5, and a preparation cost of the specialized vehicle 34 is C6, then, the relationship among those becomes C1<C4+C5+C6.

Explanation for Second Comparative Example

Figure 7A:
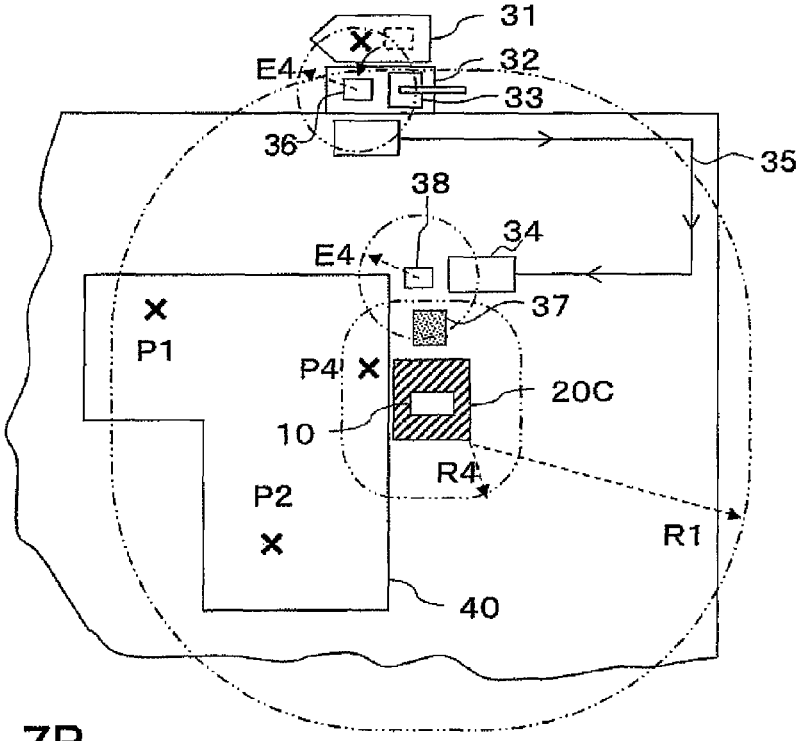
FIG. 7A shows a construction field according to a second comparative example.

In order to further verify the effect of the present invention, an explanation will be given of the second comparative example with reference to FIG. 7A showing a construction field.

According to the second comparative example, the movable area 20C of the heavy hoisting machine 10 is same as that of the first comparative example, and it is supposed that a large-size heavy construction S having a large weight W4 beyond the capacity of the fixed heavy hoisting machine 33 is installed.

In this case, it is unable to use the fixed heavy hoisting machine 33, so that a small movable heavy hoisting machine 36 which is for landing the heavy construction S loaded on the transport ship 31 must be prepared separately.

Figure 7B:
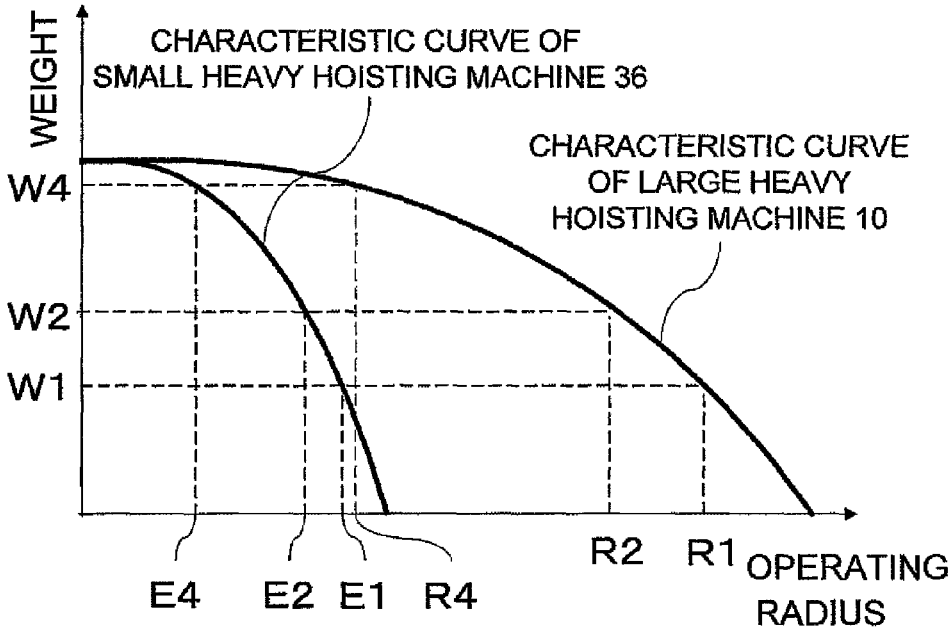
FIG. 7B is a graph in which the characteristic curve of a movable small heavy hoisting machine 36 for landing is overwritten on the characteristic curve in FIG. 3.

The small movable heavy hoisting machine 36 has a small operating radius R as indicated by a characteristic curve in FIG. 7B, so that the heavy construction S loaded on the transport ship 31 is landed and then moved (secondarily transport) in the field. Furthermore, it is necessary to prepare a temporal yard 37 where another small movable heavy hoisting machine 38 temporarily discharges the heavy construction S in the vicinity of the movable area 20C of the heavy hoisting machine 10.

Figure 8B:
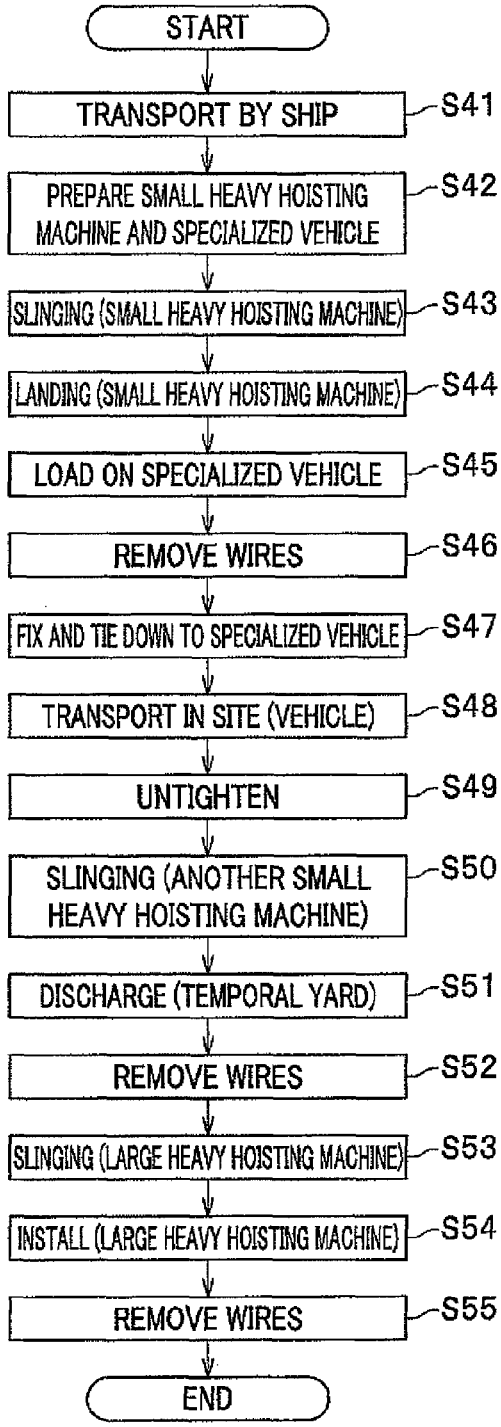
FIG. 8B is a flowchart of the second comparative example.

Next, an explanation will be given of procedures of the second comparative example with reference to the flowchart of FIG. 8B.

First, the heavy construction S is transported by the transport ship 31 (step S41), and before the transport ship 31 comes alongside the pier, the specialized vehicle 34 and the small movable heavy hoisting machine 36 are prepared at the landing place 32 and in the vicinity thereof (step S42), respectively. After the transport ship 31 comes alongside the pier, the heavy construction S loaded on the transport ship 31 is slung on the small movable heavy hoisting machine 36 (step S43), lifted and landed (step S44), once loaded on the specialized vehicle 34 (step S45), wires for hoisting are removed (step S46), and then the heavy construction S is fastened and tied down (step S47). Thereafter, the heavy construction S is transported to the proximity of the temporal yard 37 by the specialized vehicle 34 (step S48). The heavy construction S is untightened in the vicinity of the temporal yard 37 (step S49), slung on another small movable heavy hoisting machine 38 (step S50), discharged at the temporal yard 37 (step S51), and then wires for hoisting are removed (step S52).

Next, the heavy construction S is slung on the large movable heavy hoisting machine 10 at the temporal yard 37 (step S53), and lifted. The heavy hoisting machine 10 is moved and caused to change its direction to position the heavy construction S right above the installation position P, and the heavy construction S is slung down, thereby installing the heavy construction S at the installation position P (step S54). Wires for hoisting are removed from the heavy construction S (step S55), and then successive operations complete.

As explained above, according to the second comparative example, the number of works is larger than the present invention by what corresponds to the steps S42 to S53 relating to secondarily transport in the field.

Furthermore, when it is supposed that a facility cost of the movable area 20A of the present invention is C1, a facility cost of the movable area 20C of the second comparative example is C4, and a preparation cost of the small movable heavy hoisting machine 36 is C7, then a relationship among those is C1<C4+C7.

As explained above, according to the first and second comparative examples, it is difficult to suppress any increment of a construction cost of a plant.

The embodiments according to the present invention have been explained as aforementioned. However, embodiments of the present invention are not limited to those explanations, and those skilled in the art ascertain the essential characteristics of the present invention and can make the various modifications and variations to the present invention to adapt it to various usages and conditions without departing from the spirit and scope of the claims.

What is claimed is:

1. A method of installing a heavy construction, comprising a step of constructing a movable area by reinforcing a ground plane of the movable area so that a heavy hoisting machine for installing the heavy construction at a predetermined installation position is movable in the movable area, the movable area including:

a part of a first circle which is drawn around the predetermined installation position with a maximum operating radius of the heavy hoisting machine relative to a weight of the heavy construction being as a radius of the first circle; and a part of a second circle drawn around a loaded position of the heavy construction at a transport ship coming alongside a landing place with the maximum operating radius being as a radius of the second circle.

2. The heavy construction installation method according to claim 1, further comprising a step of providing a temporal landing place where the transport ship comes alongside so that an area of the constructed movable area becomes smaller than a case in which the transport ship comes alongside the landing place which is permanently provided.

* * * * *